US010825636B2

(12) United States Patent
Hu

(10) Patent No.: US 10,825,636 B2
(45) Date of Patent: Nov. 3, 2020

(54) ELECTRON GUIDING AND RECEIVING ELEMENT

(71) Applicant: Luxbright AB, Gothenburg (SE)

(72) Inventor: Qiu-Hong Hu, Gothenburg (SE)

(73) Assignee: Luxbright AB, Gothenburg (SE)

( * ) Notice: Subject to any disclaimer, the term of this patent is extended or adjusted under 35 U.S.C. 154(b) by 18 days.

(21) Appl. No.: 15/781,296

(22) PCT Filed: Dec. 4, 2015

(86) PCT No.: PCT/EP2015/078733
§ 371 (c)(1),
(2) Date: Jun. 4, 2018

(87) PCT Pub. No.: WO2017/092834
PCT Pub. Date: Jun. 8, 2017

(65) Prior Publication Data

US 2018/0358197 A1 Dec. 13, 2018

(51) Int. Cl.

| | |
|---|---|
| ***H01J 35/10*** | (2006.01) |
| ***H01J 63/02*** | (2006.01) |
| ***H01J 63/06*** | (2006.01) |
| ***H01J 35/08*** | (2006.01) |

(52) U.S. Cl.
CPC ..... *H01J 35/101* (2013.01); *H01J 35/08* (2013.01); *H01J 35/112* (2019.05); *H01J 63/02* (2013.01); *H01J 63/06* (2013.01); *H01J 35/10* (2013.01); *H01J 2235/081* (2013.01); *H01J 2235/086* (2013.01)

(58) Field of Classification Search
CPC ..... H01J 35/101; H01J 35/065; H01J 35/14; H01J 35/10; H01J 35/08; H01J 25/34; H01J 35/18; H01J 35/06; H01J 35/112
See application file for complete search history.

(56) References Cited

U.S. PATENT DOCUMENTS

| | | | |
|---|---|---|---|
| 2,640,924 | A | 6/1953 | McMillan |
| 3,286,112 | A | 11/1966 | Kiyoshi et al. |
| 3,735,187 | A | 5/1973 | Rogers et al. |
| 4,379,977 | A | 4/1983 | Carmel et al. |
| 4,531,226 | A | 7/1985 | Peschmann |

(Continued)

FOREIGN PATENT DOCUMENTS

| | | | |
|---|---|---|---|
| CN | 102427015 | A | 4/2012 |
| CN | 103219212 | B | 6/2015 |

(Continued)

OTHER PUBLICATIONS

International Search Report for Application No. PCT/EP2015/078733 dated Oct. 24, 2016 in 6 pages.

(Continued)

*Primary Examiner* — Yara B Green
(74) *Attorney, Agent, or Firm* — Knobbe, Martens, Olson & Bear, LLP

(57) ABSTRACT

The invention relates to an electron antenna as an anode for a micro- or nano-focus X-ray generation comprising an antenna base and an antenna element arranged on the antenna base such that the antenna element protrudes from a front surface of the antenna base, wherein the antenna is arranged to guide and attract the electrons in its vicinity to the top the antenna element.

20 Claims, 15 Drawing Sheets

(56) References Cited

U.S. PATENT DOCUMENTS

| | | | | |
|---|---|---|---|---|
| 6,229,876 | B1 | 5/2001 | Enck et al. | |
| 2004/0208280 | A1 | 10/2004 | Yada et al. | |
| 2004/0240613 | A1 | 12/2004 | Hamann | |
| 2006/0133576 | A1 | 6/2006 | Wilkins | |
| 2010/0111260 | A1* | 5/2010 | Motz | H01J 35/08 378/144 |
| 2010/0260322 | A1 | 10/2010 | Ito et al. | |
| 2011/0235781 | A1 | 9/2011 | Aoki et al. | |
| 2012/0201353 | A1 | 8/2012 | Kim | |
| 2014/0072102 | A1 | 3/2014 | Bleuet | |
| 2015/0117599 | A1 | 4/2015 | Yun et al. | |
| 2015/0228440 | A1 | 8/2015 | Hwu et al. | |
| 2016/0079029 | A1* | 3/2016 | Li | H01J 35/06 378/122 |
| 2016/0148777 | A1* | 5/2016 | Lan | H01J 9/39 378/122 |

FOREIGN PATENT DOCUMENTS

| | | | |
|---|---|---|---|
| DE | 10 2010 009276 | A1 | 8/2011 |
| JP | 52-020171 | A | 2/1977 |
| JP | H07-211274 | A | 8/1995 |
| JP | 2000057981 | A | 2/2000 |
| KR | 20120091591 | A | 8/2012 |
| RU | 2524351 | C2 | 7/2014 |
| WO | 2010/109909 | A1 | 9/2010 |

OTHER PUBLICATIONS

Russian Office Action for Application No. 2018124318, dated Jun. 25, 2019 in 9 pages (includes English translation).

Russian Search Report for Application No. 2018124318, dated Jun. 25, 2019 in 3 pages.

Japanese Office Action for Application No. 2018-528741, dated Dec. 23, 2019 in 7 pages (English translation).

Taiwanese Office Action and Search Report for Application No. 105140036, dated May 4, 2020 in 7 page (English translation included).

* cited by examiner

ELECTRON GUIDING AND RECEIVING ELEMENT

CROSS-REFERENCE TO RELATED APPLICATIONS

This application is the U.S. National Phase under 35 U.S.C. § 371 of International Application PCT/EP2015/078733, filed Dec. 4, 2015. The disclosures of the above-described application are hereby incorporated by reference in their entirety.

TECHNICAL FIELD

Example embodiments presented herein are directed towards an electron guiding and receiving element or an electron antenna comprising an antenna element and an antenna base, which is configured to receive electrons not as a signal for communication but as stimuli for electromagnetic radiation. Example embodiments are further directed towards x-ray tubes comprising the said electron antenna as well as applications with other wavelengths.

BACKGROUND

Most devices or machines used in a modern society are essentially the consequence of moving electrons from one location to another. The form of the motion, being translational, oscillatory, uniform or accelerated/decelerated, and the logical control of the motion define the functionality and variety of the devices or machines. The fundamental constraints on the motions are the laws of conservation, continuity and neutrality of charges. In solid state devices the electrical potential built in the power source drives the electrons to pass through the active components of a device to accomplish the functionality of the device, and flow back to the power source. In vacuum devices the electrons are emitted from an electron emitter or cathode into vacuum, where the electrons can be manipulated by adding a static or oscillatory electromagnetic field, and collected by an electron receiving element or anode. The receiving process is featured by the transfer of energy and momentum of the incident electrons to the electrons and nuclei of the anode material and consequently generation of electromagnetic radiation. Whereas the energy and momentum of the photons symbolize the corpuscular aspect of the radiation, the wavelength and frequency symbolize the undulatory aspect of the radiation. The kinetic energy of the incident electrons determines the shortest wavelength of the radiation possible that can be useful or detrimental, for X-rays the wavelength span is between 10 nm and 0.01 nm or shorter. X-ray sources are the devices harnessing such wavelengths.

An X-ray source or tube comprises an electron emitter or cathode and an electron receiver or anode. The anode is the X-ray emitter. The cathode and the anode are arranged in a particular configuration, and are enclosed in a vacuum housing. An X-ray generator is a device comprising an X-ray source (tube) and its power unit(s). An X-ray machine or system may comprise the following components, 1) an X-ray source, 2) a computerized manipulation and handling device, 3) one or more detectors, and 4) one or more power unit(s).

X-rays find applications in medical imaging, security inspection, and nondestructive testing in industry, and among others. Computer technology has revolutionized the use of X-rays in modern society, for example, X-ray CT scanner (computed tomography). The advancement in detector technology allowed for improved energy and spatial resolution, digital images and continuously-increasing scan areas. However, the technology for generating X-rays has essentially been the same since the birth of the Coolidge tube for about 100 years ago, when William D. Coolidge revolutionized the way X-rays was generated by replacing the gas-filled tubes with an evacuated tube housing a hot tungsten filament to utilize thermionic emission, U.S. Pat. No. 1,203,495 filed May 9, 1913 "Vacuum-tube". The same physics for generating X-rays is still in use today. The two key components of the Coolidge tube, the cathode of tungsten (VV) spiral filament and the anode of W-disc embedded in a copper (Cu)-cylinder still look the same, and function in the same ways in today's X-ray tubes, to be specific the stationary anode X-ray tubes in U.S. Pat. No. 1,326,029 filed Dec. 4, 1917 "Incandescent cathode device", and U.S. Pat. No. 1,162,339 filed Aug. 21, 1912 "Method of making composite metal bodies".

In the past two decades or so, the emergence of new classes of nano-materials has boosted advancement in fundamental research and applications of field emission cathodes. For the field emission cathodes based on CNTs as disclosed in the prior art X-ray devices, the total current of the electron beam was often too low to match the hot cathode for a given application. This can in principle be remedied by increasing the area of the cathode. However, larger cathode area will naturally lead to larger focal spot size and poorer spatial resolution of the image, an unwanted consequence. It is well known that the smaller the focal spot size, the higher the spatial resolution of the image. Likewise for the hot cathode X-ray tubes, in order to decrease the focal spot size to the so called micro focus range, strong electromagnetic lenses are used to focus the electron beam traversing in the space between the cathode and the anode. Consequently the region of the anode under the focal spot may be subjected to too high thermal load to maintain being solid. Melting of the anode will be the death of the tube. There have been various solutions to compromise the trade-off between the requirements for the smaller focal spot and consequently higher power load on the focal spot. Besides using electromagnetic lenses, another type of solution was disclosed in US 2002/0015473 A1 using a liquid metal jet anode. Circulation of the liquid metal in the jet carries the heat generated by the electron beam to a heat bath. However, the high vacuum condition of such a source is maintained by continuously pumping the vacuum system or the "open tube", therefore the whole device is still too bulky and complicated to fit in many industrial and medical applications where demands on compactness and mobility prevail.

SUMMARY

In previous patent applications from the applicant, WO2015/118178 and WO2015/118177, an inventive type of non-CNT-based electron emitters allowing for emission mechanisms other than thermionic emission for X-ray generation, and an inventive X-ray device were disclosed, to bring in new and advantageous features of such sources to X-ray imaging.

In the present application a fundamentally new concept of an electron antenna is put forward to replace the notion of an anode in a vacuum device for generating electromagnetic radiation. The present application is to provide an electron antenna as replacement for anode for X-ray generation, and to provide micro- or nano-focus X-ray tubes comprising the said electron antenna.

An anode, the counter electrode of the cathode, is one of the key components of an X-ray tube; whose function is to receive the electrons emitted from the cathode, to emit X-rays, and at the same time to be able to conduct the heat—a byproduct of X-ray generation process—to the ambience. The area where the electron beam hits the anode is called the focal spot. In stationary anode tubes, the anode is made of a small tungsten disc embedded in a more bulky copper cylinder with the front surfaces coplanar; a structure and method of making thereof was invented by William. D. Coolidge in 1912 and disclosed in U.S. Pat. No. 1,162,339. In such prior art X-ray tubes, the shape of the focal spot is the projected image of the cathode onto the surface, preferably at the center, of the disc; and the size and the position of the focal spot are determined by electromagnetic field in the space between the cathode and the anode with or without electromagnetic lenses. The anode receives loyally the number of electrons emitted from the cathode, but is completely unable to do anything to steer or distribute the electrons. In other words, the anode does not have anything to do with determining the focal spot size.

The embodiments disclosed herein will change this. By applying the concept of electron antenna to a redesign of an x-ray tube, the anode is put in the position to determine the focal spot size. The concept of an electron antenna can also be used to produce micro or nano focus UV light beams or visible light beams. The concept thus works to produce micro or nano focus radiation beams of various wavelengths depending on the material and/or structure of the electron antenna. Some example embodiments will be described below.

An antenna is defined as "that part of a transmitting or receiving system that is designed to radiate or receive electromagnetic waves." Readers are referred to *IEEE Standard definitions of Terms for Antennas: IEEE Standard* 145-1993, *IEEE,* 28 pp., 1993 for the complete document. Generally a receiving antenna comprises an antenna element and an antenna base. The former is structured and configured to most efficiently receive the signal, whereas the latter acts as the support of the former and transmits the signal further. The electron antenna, as its name suggests, is intended to most efficiently receive electrons. To be precise, it is the antenna element that is structured and configured to receive all electrons coming towards it and confine them into a predefined region, whereas the antenna base is structured and configured to conduct the electricity and the heat. Though it may appear evident, it ought to be pointed out that, 1) the physical object received by the electron antenna is not electromagnetic radiation but a beam of electrons; 2) the electrons received are not used as signals for communication but as stimuli for electromagnetic radiation. The concept of antenna is hence bestowed of new context through the above two extensions.

In the redesign of X-ray tubes, the concept of an electron antenna is in one example embodiment implemented by replacing the W-disc coplanar to the Cu-cylinder acting as an anode with a thin metallic blade protruding from the Cu-cylinder acting as an antenna element. The protrusion and high aspect ratio of the antenna element cause a local enhancement of the electric field at the top end of the antenna element, and the field line will be concentrated at the top end. Thus the antenna element is able to attract or guide all electrons towards it and leave the antenna base free of incoming electrons. As a result, X-rays can only be generated within the area of the top surface of the antenna element and; in other words, the geometric features of the focal spot are determined by the antenna element. As can be seen, the fundamental difference between a prior art disc anode and an electron antenna in the context of X-ray generation lies in that the disc anode passively receives the numbers of electrons from the cathode, but does not determine the focal spot size; whereas the electron antenna actively guide and attract the electrons towards it, and determines the focal spot size.

Thus, at least one object of the example embodiments presented herein is to introduce a fundamentally new concept of electron antenna and provide a fundamentally different mechanism and technology for guiding and focusing the electron beam to and collecting the electrons at the antenna element to generate X-rays from within the area of the top surface of the antenna element, whose length scale may vary from millimeters down to nanometers. In this way the focal spot size is controlled to the size never exceeding the size of the top surface of the antenna element, and the focal spot size is less dependent on the shape and the size of the cathode. The X-ray tubes comprising the electron antenna will provide drift-free micro- or nano-focus capability and be much more compact, less costly, durable and versatile. This applies also to the production of UV light and visible light in vacuum tubes using the same electron antenna technique.

Accordingly, the example embodiments presented herein are directed towards an electron antenna comprising an electron antenna element and an antenna base to define the position, shape and dimension of the X-ray focal spot and to dissipate the heat generated as a by-product of X-ray generation. Example embodiments are further directed towards x-ray tubes comprising the said electron antenna. By replacing the antenna element with different materials or structures in the below description, UV light or visible light can be produced.

Antenna Element:

Instead of being shaped to a disc as in conventional anode, the antenna element is in one example embodiment shaped into a thin blade. More example embodiments follow.

The dimension of the cross section and the inclination angle of the blade define the dimension of focal spot of the X-ray beam.

The antenna element can be made of various metals and alloys, e.g. W and W—Re.

Furthermore, the antenna element can be made in various shapes to meet the need for the shape of the X-ray focal spot.

Furthermore, the antenna element can be made in various sizes to meet the need for the size of the X-ray focal spot in a range from millimeters down to nanometer scale.

Furthermore, the antenna element can in one example embodiment be manufactured by EDM (electrical discharge machining) of thin sheet of the respective metals or alloys or by punching.

Antenna Base:

The antenna base can be made of various metals, alloys, compounds or composites preferably possessing high electrical conductivity, high thermal conductivity, high melting temperature and machinability or formability.

Fusion of Antenna Element and Antenna Base:

The surfaces of the antenna element that are in contact with the base can be coated with a thin layer of the same material as the base or a material intermediate between the base and the antenna element to enhance the thermal and/or electrical affinity between the antenna element and the base.

The fusion or joining of the antenna element and the antenna base can be made by mechanical pressure supplied from screws and/or pivots or by vacuum casting.

Configuration in X-ray Tube:

The antenna is configured in the same spatial relation to the cathode cup as in a normal stationary anode X-ray tube or rotating anode X-ray tube.

X-ray Devices:

The example embodiments presented herein are directed towards an X-ray device comprising the said electron antenna.

An X-ray device comprising the said electron antenna can be configured to a single hot cathode micro- or nano-focus tube, when combined with one hot filament cathode.

An X-ray device comprising the said electron antenna can be configured to a single field emission cathode micro- or nano-focus tube, when combined with one field emission cathode.

An X-ray device comprising the said electron antenna can also be configured to a dual cathode micro- or nano-focus tube, when combined with a cathode cup holding one field emission cathode and one hot filament cathode.

An X-ray device comprising the said electron antenna can as well be configured to a micro- or nan-focus tube with multiple excitation sources comprising multiple (thermionic or field emission) cathodes and electron antenna elements, when an insulating antenna base is used.

An X-ray device comprising the said electron antenna can further be configured to a triode field emission micro- or nano-focus tube, when combined with an electron emitter comprising a gate electrode.

The field emission cathode can be further configured to allow for thermally assisted emission, such as Schottky emission.

An X-ray device comprising the said electron antenna can be configured to one type of rotating anode micro- or nano-focus tube, when single or multiple antenna elements are circularly embedded in the rotating disc.

An X-ray device comprising the said electron antenna can be configured to another type of rotating anode micro- or nano-focus tube, when multiple antenna elements are radially embedded in the rotating disc with equal angular-space.

Example Advantage of Embodiments:

The use of the said electron antenna mechanism or technology allows for a simpler and more economic approach to more compact micro- or nano-focus tubes. The use of the said electron antenna also allows this type of micro focus tubes to be used in applications where macro focus tubes dominated prior.

Applications:

Some of the example embodiments are directed towards the use of the X-ray generating device described above, in a security X-ray scanning apparatus.

Some of the example embodiments are directed towards the use of the X-ray generating device described above, in non-destructive testing.

Some of the example embodiments are directed towards the use of the X-ray generating device described above, in medical imaging apparatus for whole body or parts or organs scans such as computed tomography scanner, (mini) C-arm type scanning apparatus, mammography, angiography and dental imaging devices.

Some of the example embodiments are directed towards the use of the X-ray generating device described above, in a geological surveying apparatus, diffraction apparatus, and fluorescence spectroscopy.

Some of the example embodiments are directed towards the use of the X-ray generating device described above, in X-ray phase contrast imaging.

Some of the example embodiments are directed towards the use of the X-ray generating device described above, in X-ray colour CT imaging.

The electron antenna may also be an anode for production of a micro- or nano-focus UV light beam, wherein the antenna element comprises one or more of a quantum well or quantum dot arranged at the top surface of the antenna element. A UV light generating device may comprise such an electron antenna.

UV light generating device may be a rotating anode micro- or nano-focus tube, wherein one or a plurality of antenna elements are circularly embedded in a rotating antenna base disc.

The electron antenna may be an anode for production of a micro- or nano-focus visible light beam, wherein the antenna element comprises a layer of a phosporenscent material or a fluorescent material arranged at the top surface of the antenna element. A visible light generating device may comprise such an electron antenna.

The visible light generating device may be a rotating anode micro- or nano-focus tube, wherein one or a plurality of antenna elements are circularly embedded in a rotating antenna base disc.

BRIEF DESCRIPTION OF THE DRAWINGS

The foregoing will be apparent from the following more particular description of the example embodiments, as illustrated in the accompanying drawings in which like reference characters refer to the same parts throughout the different views. The drawings are not necessarily to scale, emphasis instead being placed upon illustrating the example embodiments.

DETAILED DESCRIPTION

In the following description, for purposes of explanation and not limitation, specific details are set forth, such as particular components, elements, techniques, etc. in order to provide a thorough understanding of the example embodiments. However, it will be apparent to one skilled in the art that the example embodiments may be practiced in other manners that apparently depart from but inherently connected to these specific details. In other instances, detailed descriptions of well-known methods and elements are omitted so as not to obscure the description of the example embodiments. The terminology used herein is for the purpose of describing the example embodiments and is not intended to limit the embodiments presented herein.

Figure 1A:
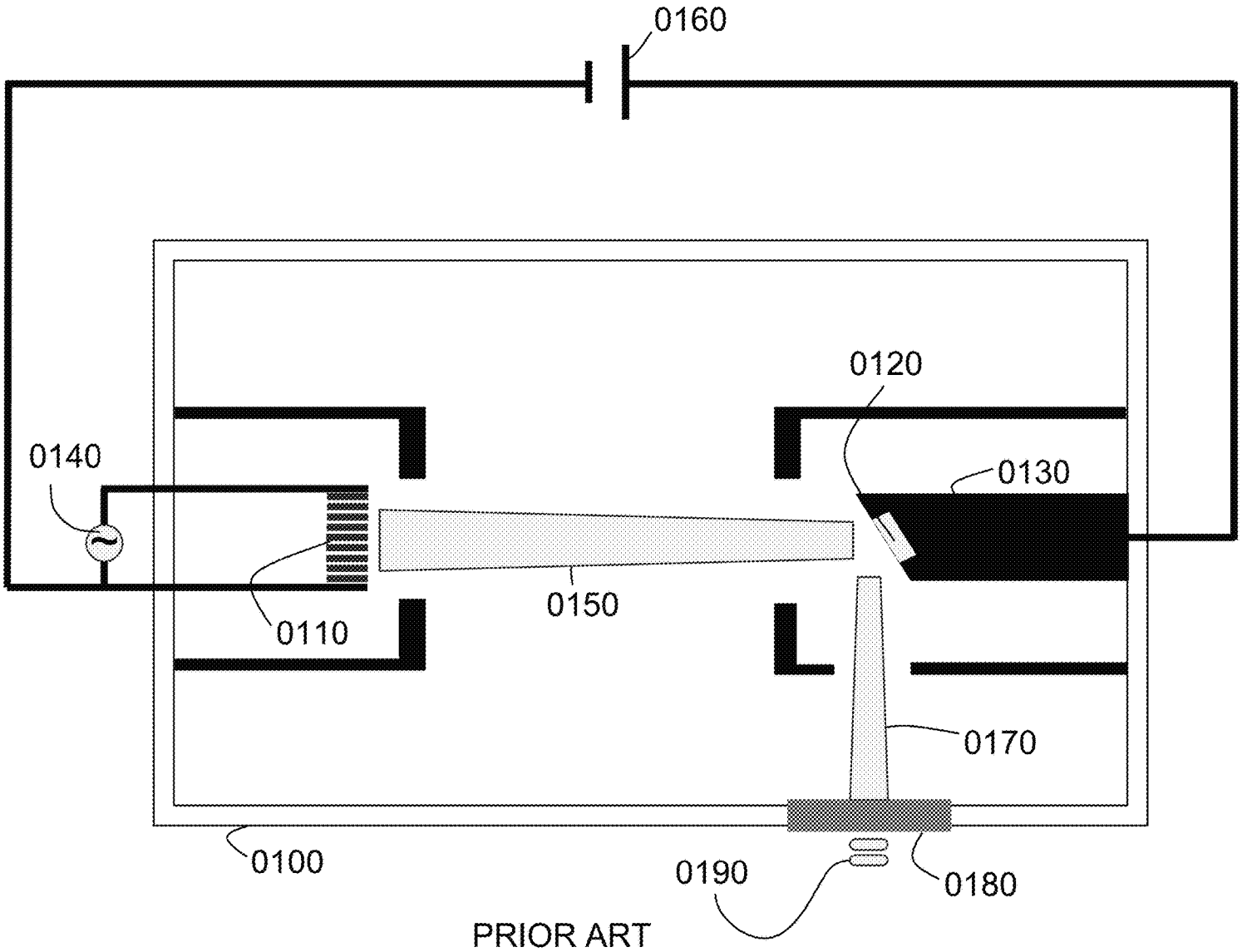
FIGS. 1A-1C Schematically show prior art x-ray tubes: 1A is a schematic of an X-ray tube comprising a conventional anode, no micro-focus; 1B is a schematic of a micro focus X-ray tube comprising a conventional anode and electromagnetic lenses, 1C depicts micro focus X-ray generation using a liquid metal jet anode.

Problems:

In order to better describe the example embodiments, a problem will first be identified and discussed. FIG. 1A illustrates a traditional X-ray tube. The X-ray tube of FIG. 01A features an evacuated glass tube 0100 comprising a hot filament cathode 0110 and a W-disc anode 0120 embedded in a Cu-cylinder 0130. The surface of the anode 0120 faces the cathode 0110 at a predetermined inclination angle or anode angle. An electric current, provided by a power supply 0140, passes through the filament cathode 0110 causing an increase in the temperature of the filament 0110 to a level for it to emit a beam of electrons 0150 from this filament. The electrons in the beam 0150 are then accelerated towards the anode 0120 by a potential difference provided by a power source 0160. The resulting X-ray beam 0170 is directed out of the device via a window 0180. The voltage difference between the cathode and the anode determines the energy of the X-ray beam, not micro-focus. A typical "double banana" shaped focal spot is indicated by 0190.

Figure 1B:
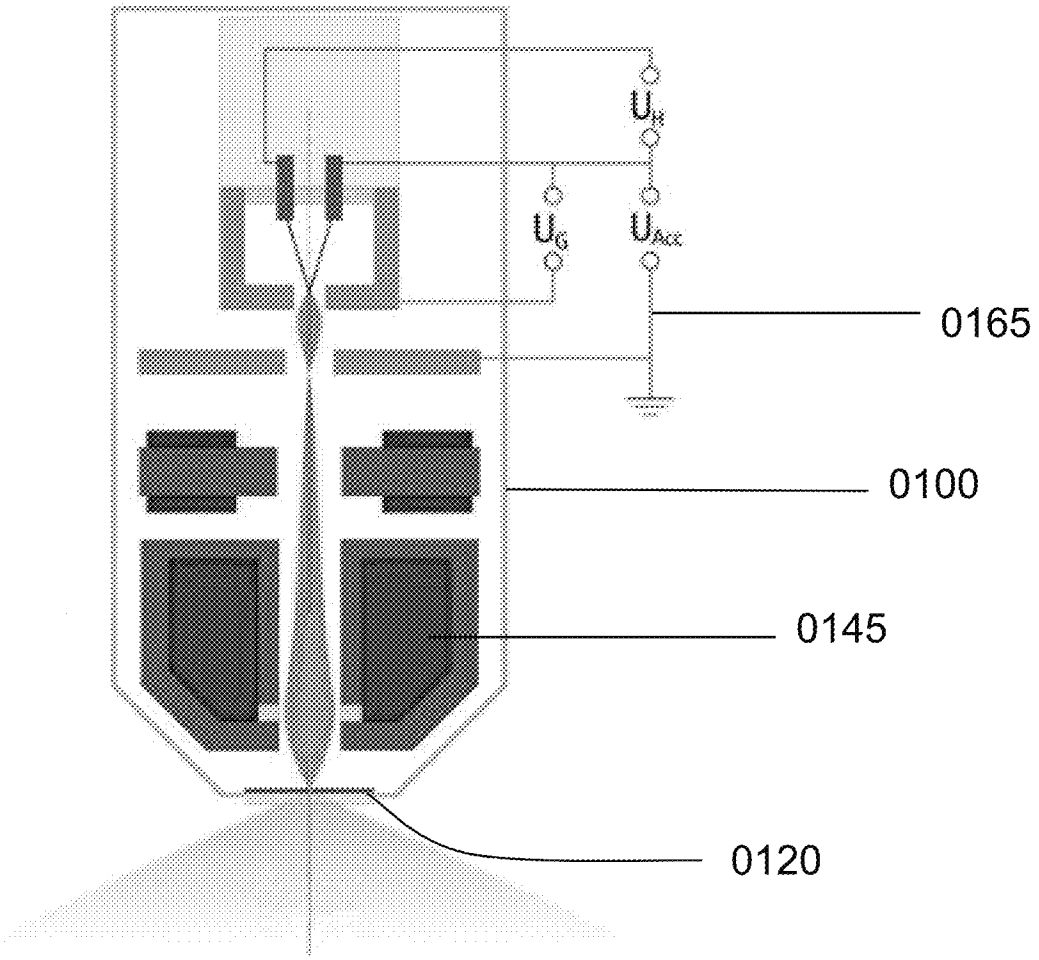
PRIOR ART FIGURE 01B

FIG. 1B is a schematic of a prior art micro-focus X-ray device comprising a transmission anode 0120 and electromagnetic lenses 0145. The lenses add extra size and weight, and cost to the tube 0100; and needs an additional power source 0165 to drive the lenses and to be synchronized with the output voltage of the tube. Therefore this type of micro-focus tubes has issues concerning the size and weight and cost, and lateral drift of the X-ray beam. For further information, see for instance, www.phoenix-xray.com.

Figure 1C:
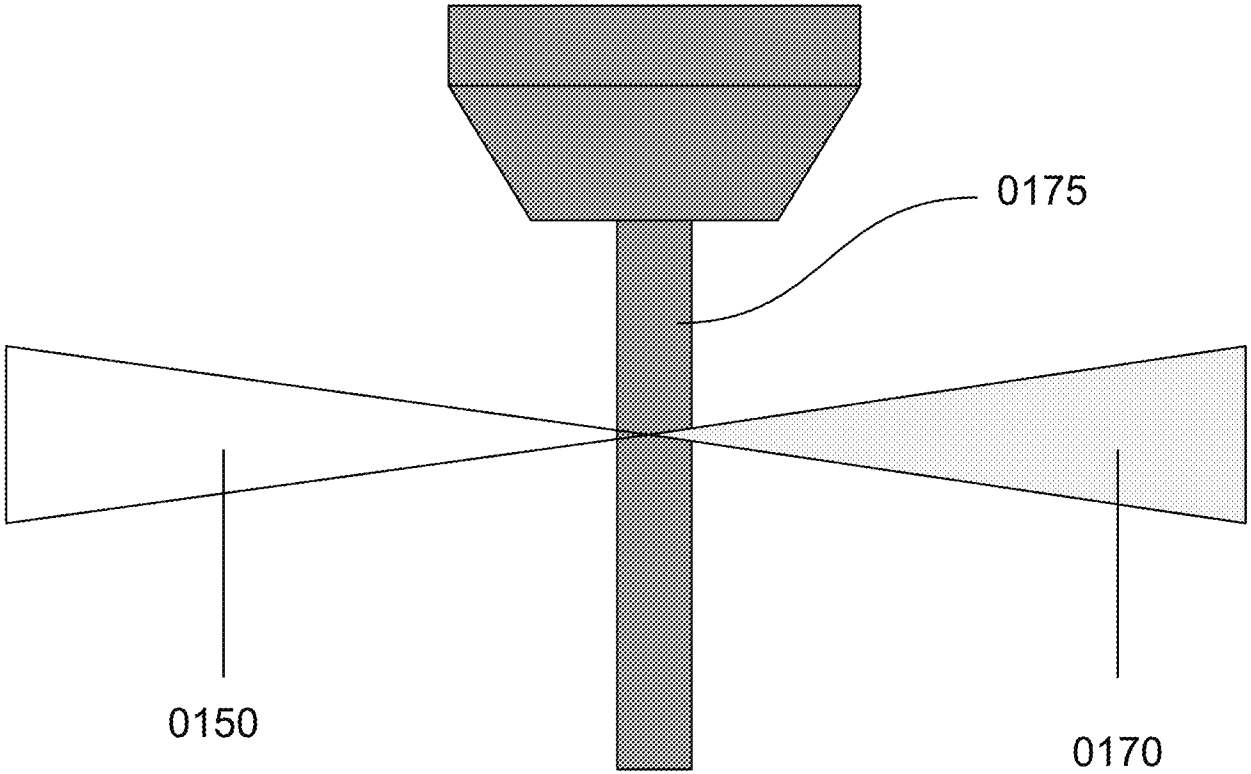
PRIOR ART FIGURE 01C

FIG. 1C is a schematic of prior art micro focus X-ray generation using a liquid metal jet anode 0175. The electron beam 0150 hits the liquid metal jet 0175 resulting in an X-ray beam 0170. The liquid metal jet anodes require a so called open tube meaning that the high vacuum condition is maintained by continuous pumping of the tube. Such solution is bulky and expensive. In addition, anode materials are limited to the metals with low melting temperature. For further information, see for instance www.excillum.com Example Embodiments:

Example embodiments presented herein are directed towards an electron guiding and receiving element or an electron antenna comprising an antenna element and an antenna base, which is configured to receive electrons not as a signal for communication but as stimuli for electromagnetic radiation. Example embodiments are further directed towards x-ray tubes comprising the said electron antenna.

The electron antenna comprises an antenna element and an antenna base. The antenna element is structured and configured to receive all electrons coming towards it and confine them into a predefined region, whereas the antenna base is structured and configured to conduct the heat electricity and/or electricity.

Figure 2:
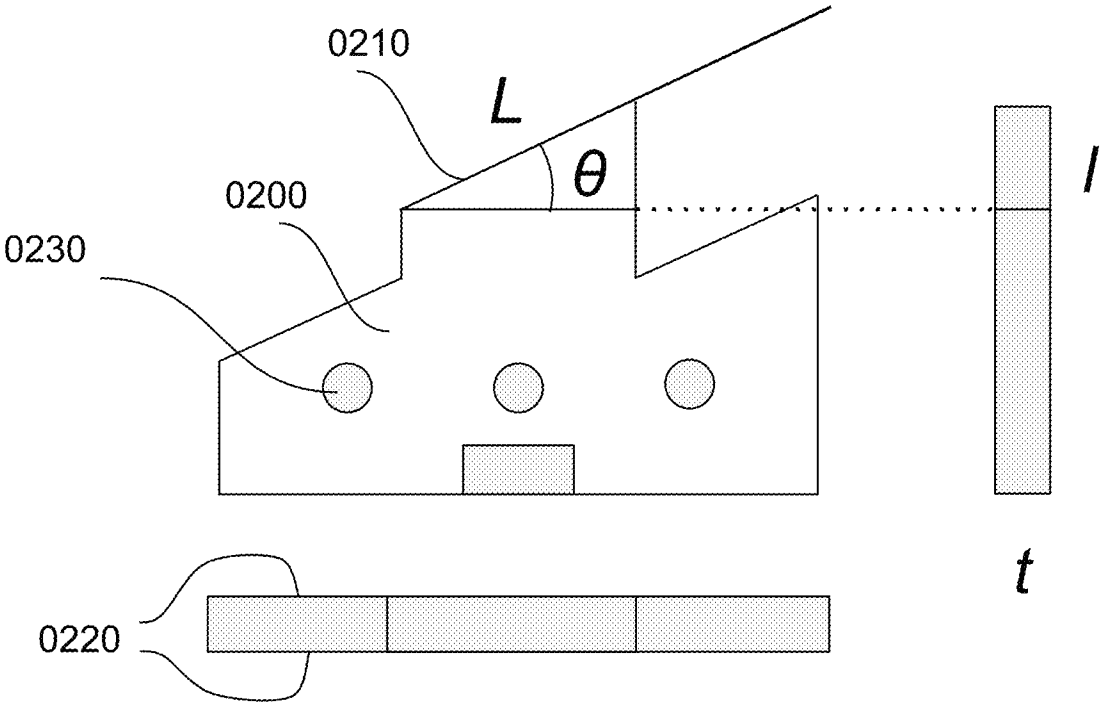
FIG. 2 is an illustrative example of an electron antenna element, according to some of the example embodiments described herein.

Antenna Element:

FIG. 2 is an illustrative example of an electron antenna element 0200 shaped to a thin blade, according to some of the example embodiments described herein; with the top surface or top edge 0210 of the element intended to receiving the electrons. 0220 indicates the two faces of the antenna element, θ denotes the inclination angle or anode angle, t denotes the thickness of the blade, and L denotes the length of the top surface. The maximum length of the top surface is 10 mm, and can vary from 10 mm down to nanometers. The anode angle θ can vary between a few degrees, e.g. 5 degrees to 45 degrees. The dimension of the cross section and the inclination angle θ of the blade define the dimension of focal spot of the X-ray beam such that the width of the blade limits the width of the focal spot, and the length of the focal spot is limited by $I=L \sin \theta$. The holes 0230 are for positioning and fixing the element with respect to the antenna base. The L and t of the antenna element can be made in various sizes to meet the need for the size of the X-ray focal spot. A preferred range is from (L=10, t=0.1) mm down to a disc of radius of 10 nm. In high power applications, however, the focal spot area can be as big as $8\times8$ $mm^2$.

Figure 3A:
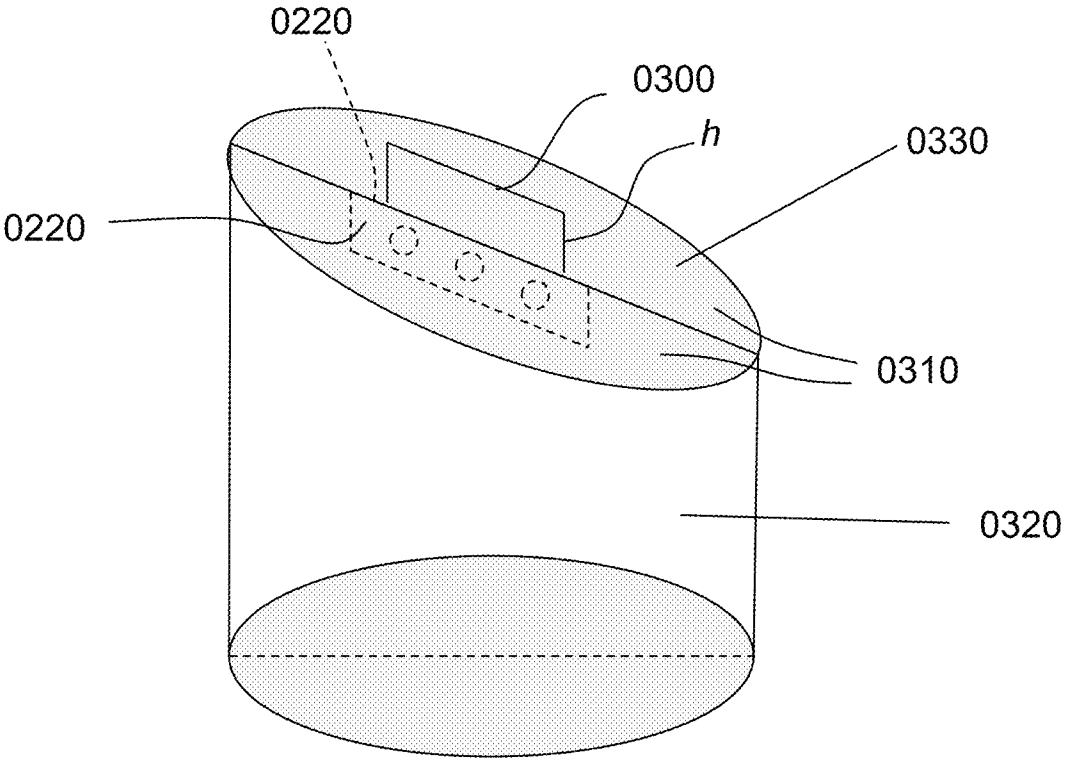
FIG. 3A is a schematic of an electron antenna comprising an antenna element and an antenna base, according to some of the example embodiments described herein.

FIG. 3A is a schematic of an electron antenna according to one example embodiment described herein, 0300 is the blade shaped antenna element sandwiched between two half cylindrical blocks 0310 forming the antenna base 0320 with the two faces 0220 of the antenna element 0300 in contact with the antenna base 0320. In one example embodiment two half cylindrical Cu blocks 0310 act as the antenna base 0320. The upper part of the blade is configured to protrude out of and in parallel to an inclined front surface of the cylinder 0330. The height of the protrusion h is in a range of 0.001-5 mm and is determined in proportion to the focal spot size. The aspect ratio, defined as the division of the height to the width, h/t, is in the range of 10-100.

Figure 3B:
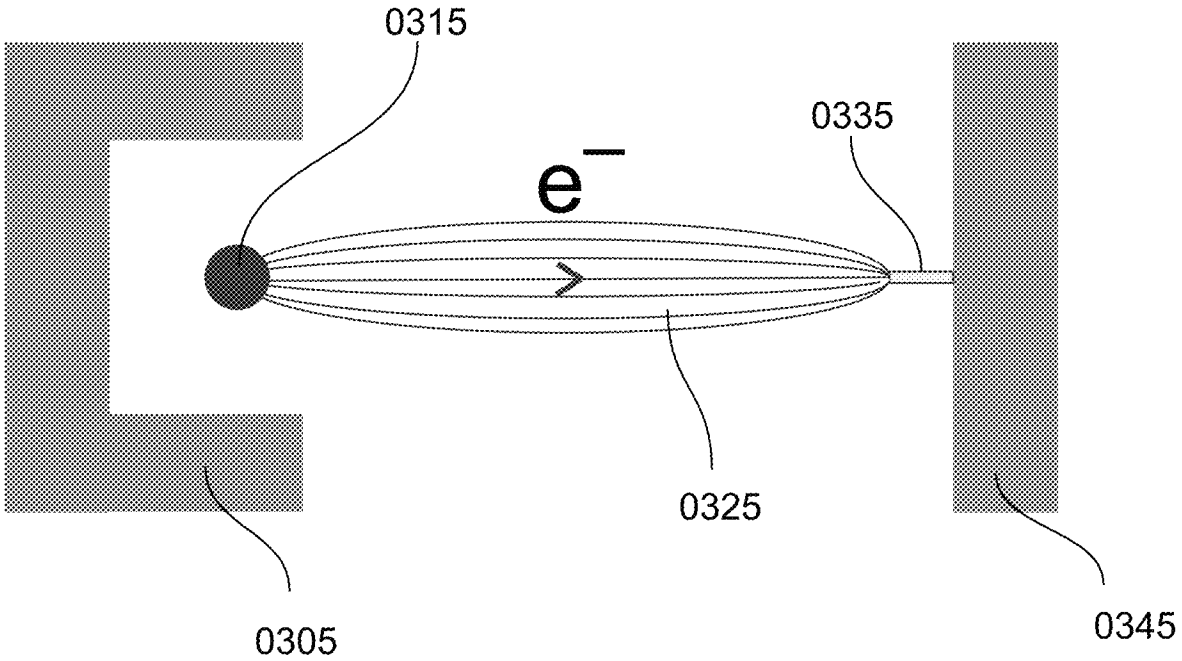
FIG. 3B is an illustration of the electron antenna and its physical principle for guiding and receiving electrons.

FIG. 3B shows a schematic side view of an assembly of a hot filament cathode and the electron antenna, and illustrates the guiding and focusing principle of the antenna. The assembly comprises a cathode cup 0305, a hot filament 0315, the electron beam 0325, the electron antenna element 0335, and the antenna base 0345. As can be seen, the entire electron beam is focused on the antenna element 0335.

The antenna element can be made of various metals, including but not limited to W, Rh, Mo, Cu, Co, Fe, Cr and Sc etc.; or alloys, including but not limited to W—Re, W—Mo, Mo—Fe, Cr—Co, Fe—Ag and Co—Cu—Fe etc. to meet the requirements for specific applications.

Figure 4:
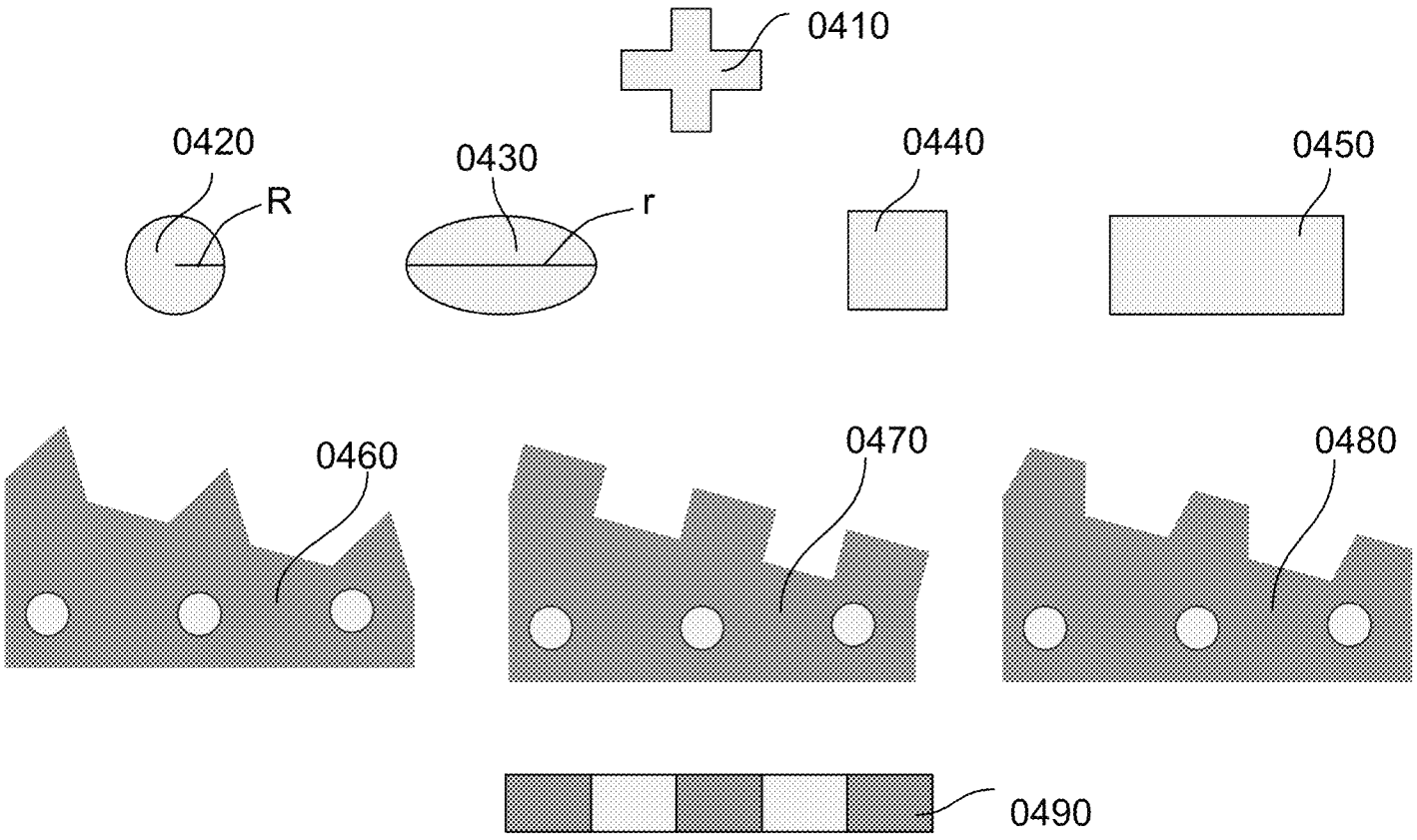
FIG. 4 is an illustrative example of different shapes an electron antenna element may have, according to some of the example embodiments described herein.

FIG. 4 is an illustration of different shapes an electron antenna element may have, according to some of the example embodiments described herein. The top surface of the antenna element can be made in various shapes to meet the need for the shape of the X-ray focal spot, including but not limited to cross 0410, circular disc 0420, elliptical disc 0430, square 0440, rectangle 0450 and several kinds of linear segments 0460-80. 0490 is the top view of 0480, and so can the entire antenna element be. The edges of the top surfaces can be smoothed to satisfy certain need for specific distribution of local electric field. It is noted that the shape of the top surface reflects directly or indirectly the shape of the cross section of the antenna element.

The diameter of the circular disc, the semi-major axis of elliptical disc, the side of square, and the long side of the rectangle may be between 10 nm-10 mm.

Antenna Base:

The antenna base is made of various metals, alloys, compounds or composites preferably possessing high electrical conductivity, high thermal conductivity, high melting temperature and machinability or formability. In preferred embodiment, the materials include but not limited to Cu, Mo, BN, and Al2O3.

Figure 5:
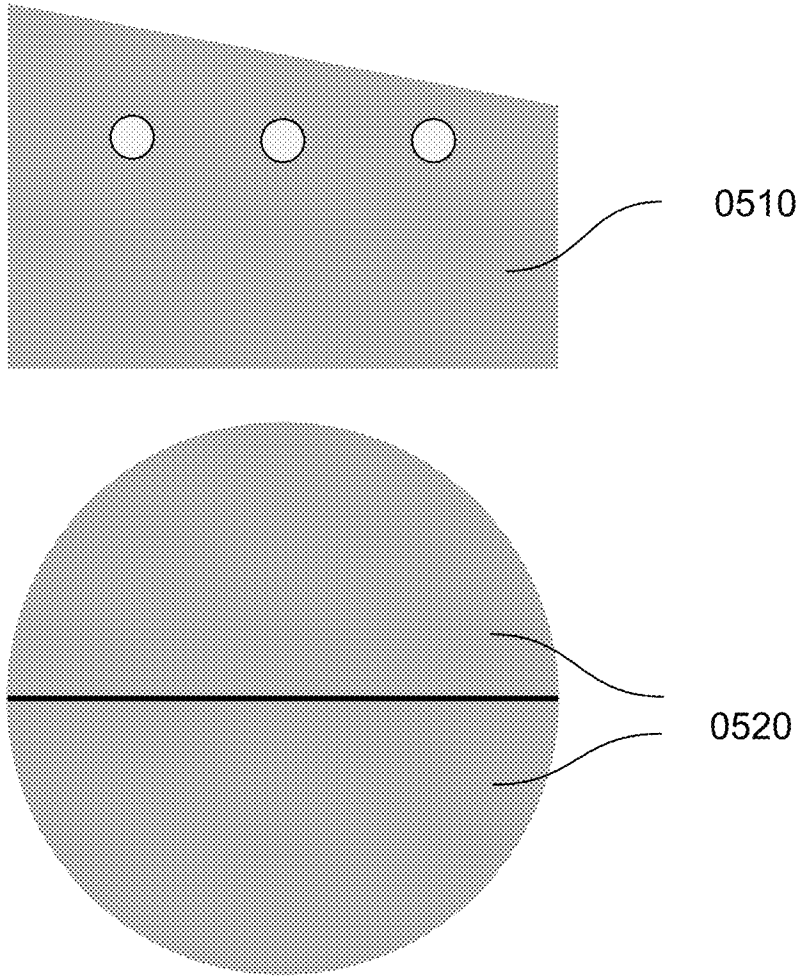
FIG. 5 is an illustration of an electrically conductive antenna base e.g. Cu for single antenna element in one example embodiment.

FIG. 5 is an illustration of an electrically conductive antenna base e.g. Cu for single antenna element in one example embodiment, 0510 is the side view of the antenna base, and 0520 is the top view of the antenna base. A beneficial feature of an electrically conductive base is that it can be used as the electrical feed through.

Figure 6:
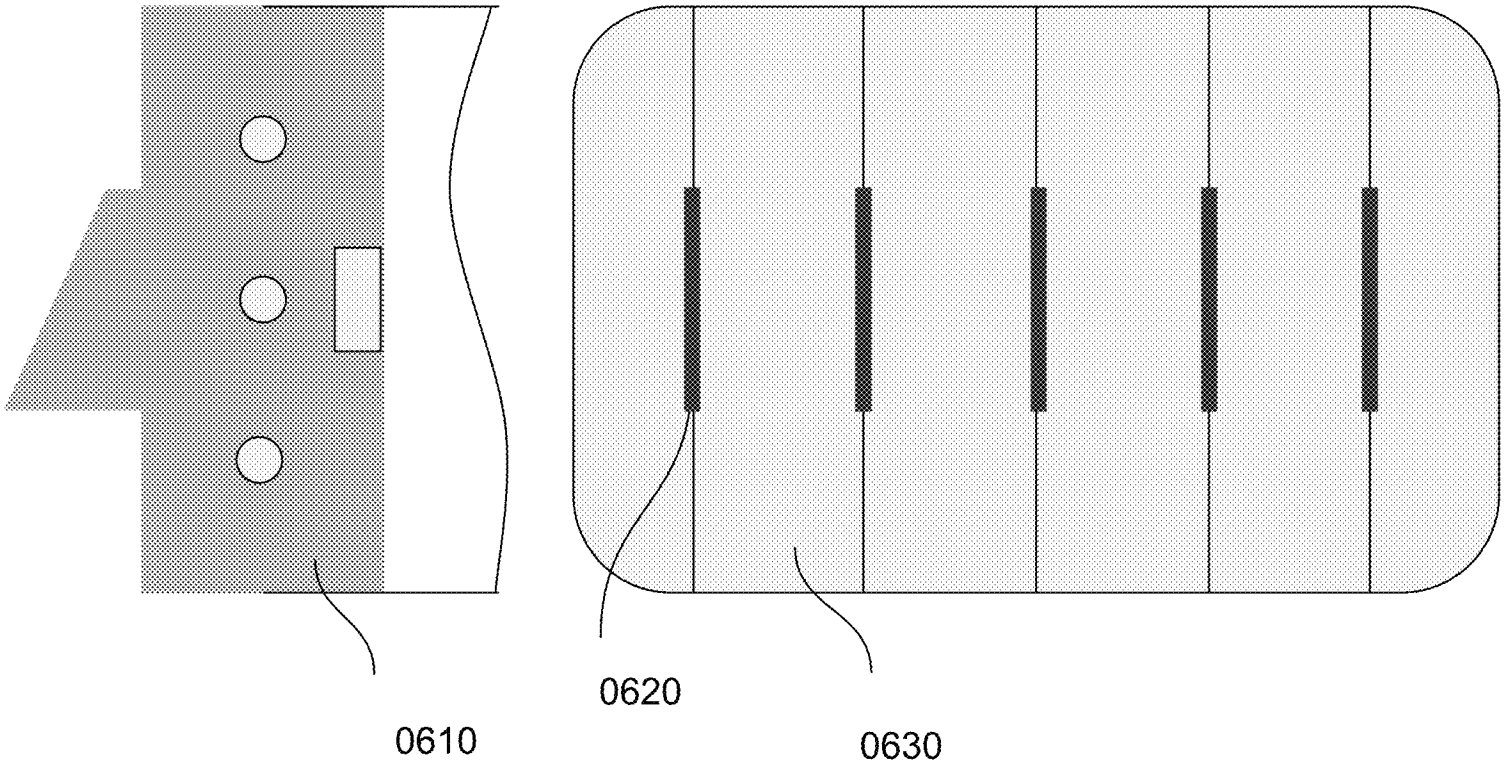
FIG. 6 is a schematic of an electron antenna comprising multiple antenna elements when the antenna base is made of an insulating material, e.g. BN or Al2O3, according to some of the example embodiments described herein.

FIG. 6 is a schematic of an antenna base made of an electrical insulating material, e.g. BN or Al2O3, according to some of the example embodiments described herein; 0610 is the side view of an antenna element, and 0620 is one of the multiple antenna elements sandwiched in parallel between BN or Al2O3 blocks acting as insulating antenna base 0630. In this case, multiple antenna elements can be assembled to constitute a multiple focal spots tube. It ought to be noted that these antenna elements 0620 can be made of not necessarily the same material.

Fusion of Antenna Element and Antenna Base:

The surfaces of the antenna element that are in contact with the base can be coated with a thin layer of the same material as the base or a material intermediate between the base and the antenna element to enhance the thermal and/or electrical affinity between the antenna element and the base. The layer may have a thickness of between 10 μm and 50 nm.

The fusion or joining of the antenna element and the antenna base can be made by mechanical pressure supplied from screws and/or pivots or by vacuum casting.

Configuration in X-ray Tube:

The antenna is configured in the same spatial relation to the cathode cup as in a normal stationary anode X-ray tube or rotating anode X-ray tube.

X-ray Devices:

The example embodiments presented herein are directed towards an X-ray device comprising the said electron antenna. The features of the X-ray device in later figures that are unaltered with respect to those of earlier figures have the same numbering. An X-ray device comprising the said electron antenna can be configured to a single hot cathode micro- or nano-focus tube, when combined with one hot filament cathode.

Figure 7:
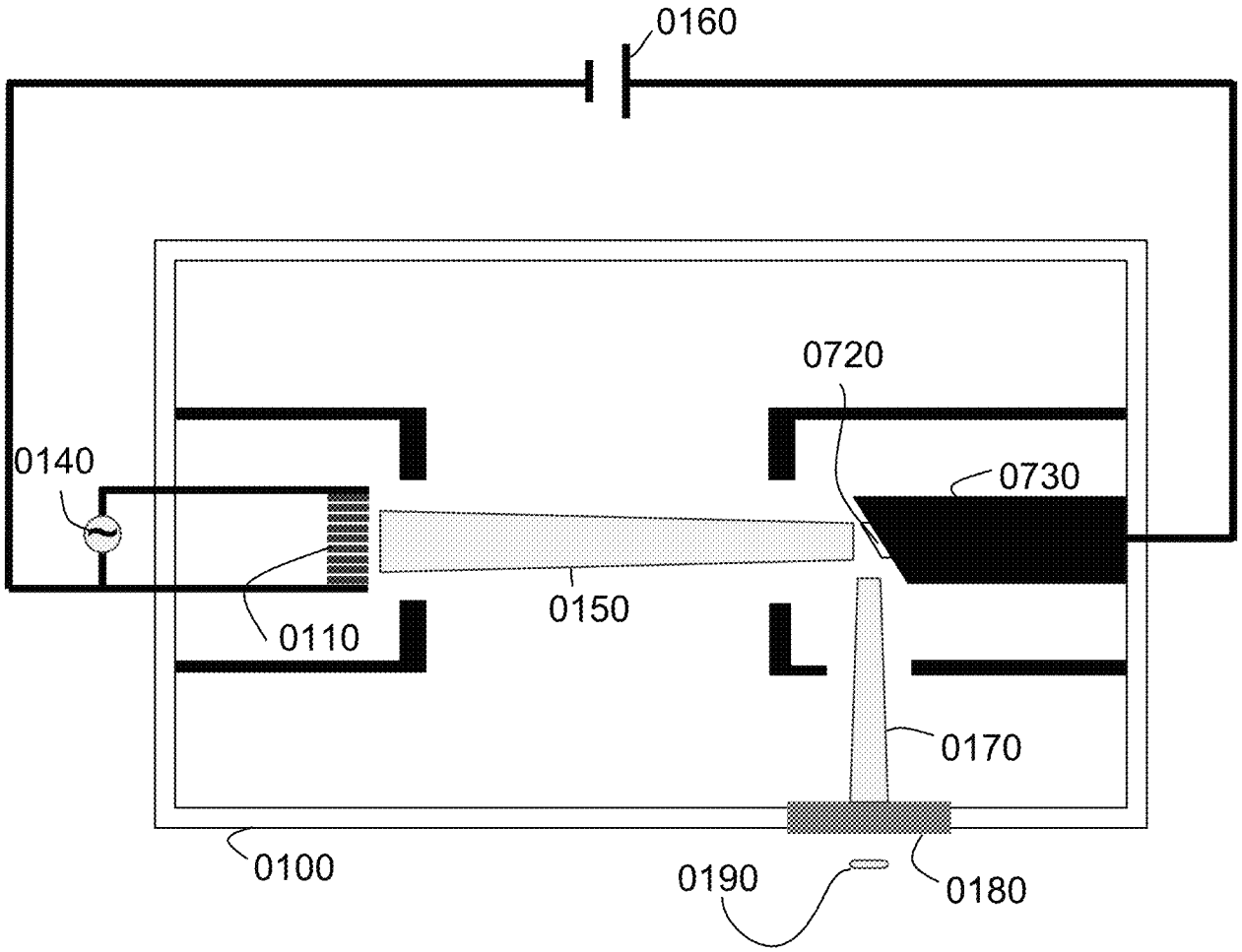
FIG. 7 is a schematic of an X-ray tube comprising one hot cathode and an electron antenna.

FIG. 7 is a schematic of such an X-ray tube comprising a single hot cathode 0110 and an electron antenna; where 0720 and 0730 denote the antenna element and the antenna base, respectively.

An X-ray device comprising the said electron antenna can be configured to a single field emission cathode micro- or nano-focus tube, when combined with one field emission cathode.

Figure 8:
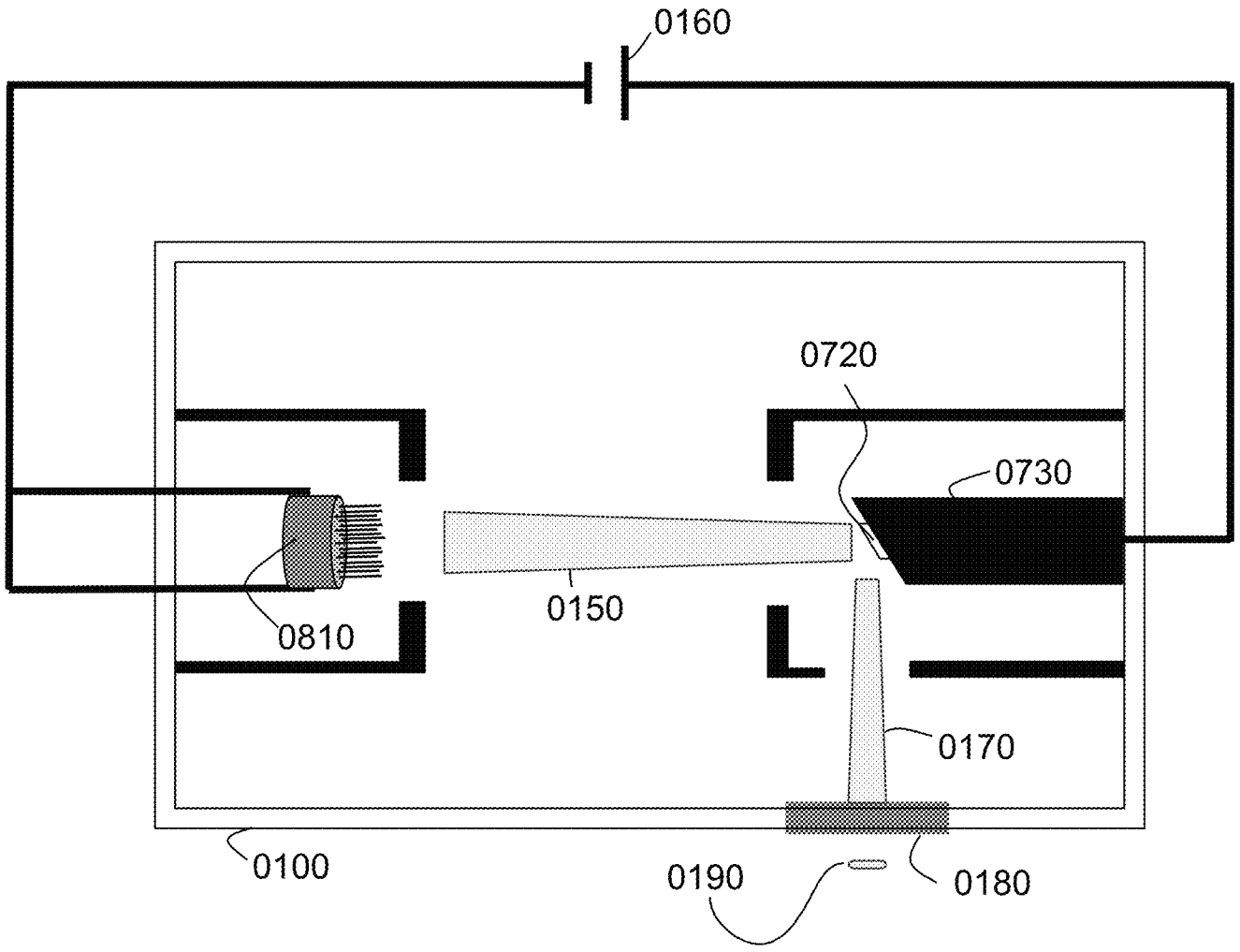
FIG. 8 is a schematic of an X-ray tube comprising one field emission cathode and an electron antenna.

FIG. 8 is a schematic of such an X-ray tube comprising one field emission cathode 0810 and electron antenna comprising one antenna element 0720 and antenna base 0730.

An X-ray device comprising the said electron antenna can also be configured to a dual cathode micro- or nano-focus tube, when combined with a cathode cup holding one field emission cathode and one hot filament cathode.

Figure 9:
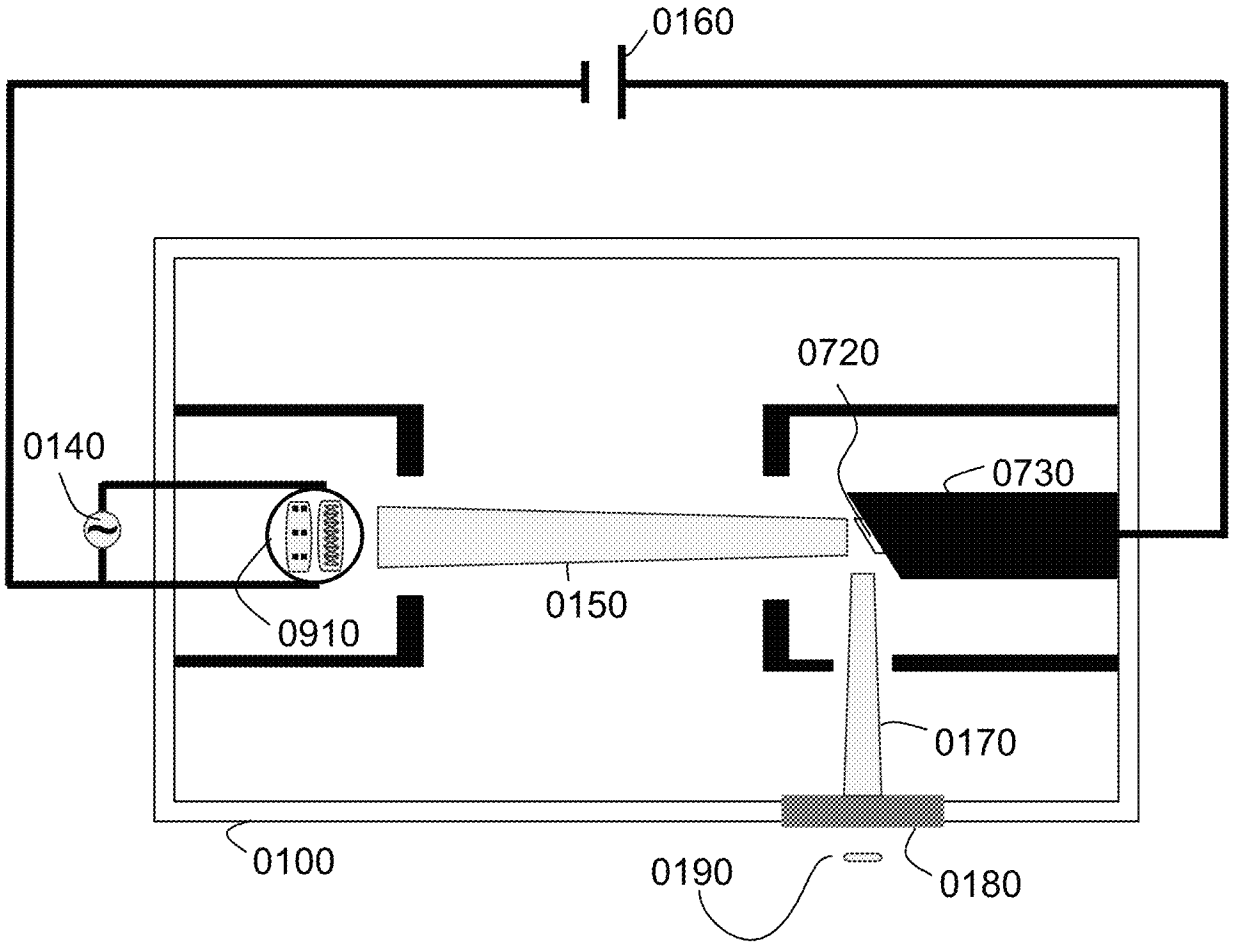
FIG. 9 is a schematic of an X-ray tube comprising a dual cathode, i.e. one field emission cathode and one hot filament cathode; and an electron antenna.

FIG. 9 is a schematic of such an X-ray tube comprising dual cathode, i.e. one field emission cathode and one hot filament cathode; and an electron antenna comprising an antenna element 0720 and an antenna base 0730; where 0910 denotes a cathode cup holding the dual cathode, and 0140 denotes the power unit for the hot filament cathode.

An X-ray device comprising the said electron antenna can as well be configured to a micro- or nan-focus tube with multiple excitation sources comprising multiple (thermionic or field emission) cathodes and electron antenna elements, when an insulating antenna base is used; see FIG. 6 for a schematic of such a multiple elements antenna, 0620 and 0630 for the antenna elements and the antenna base, respectively.

An X-ray device comprising the said electron antenna can further be configured to a triode field emission micro- or nano-focus tube, when combined with a field electron emitter comprising a gate electrode.

Figure 10:
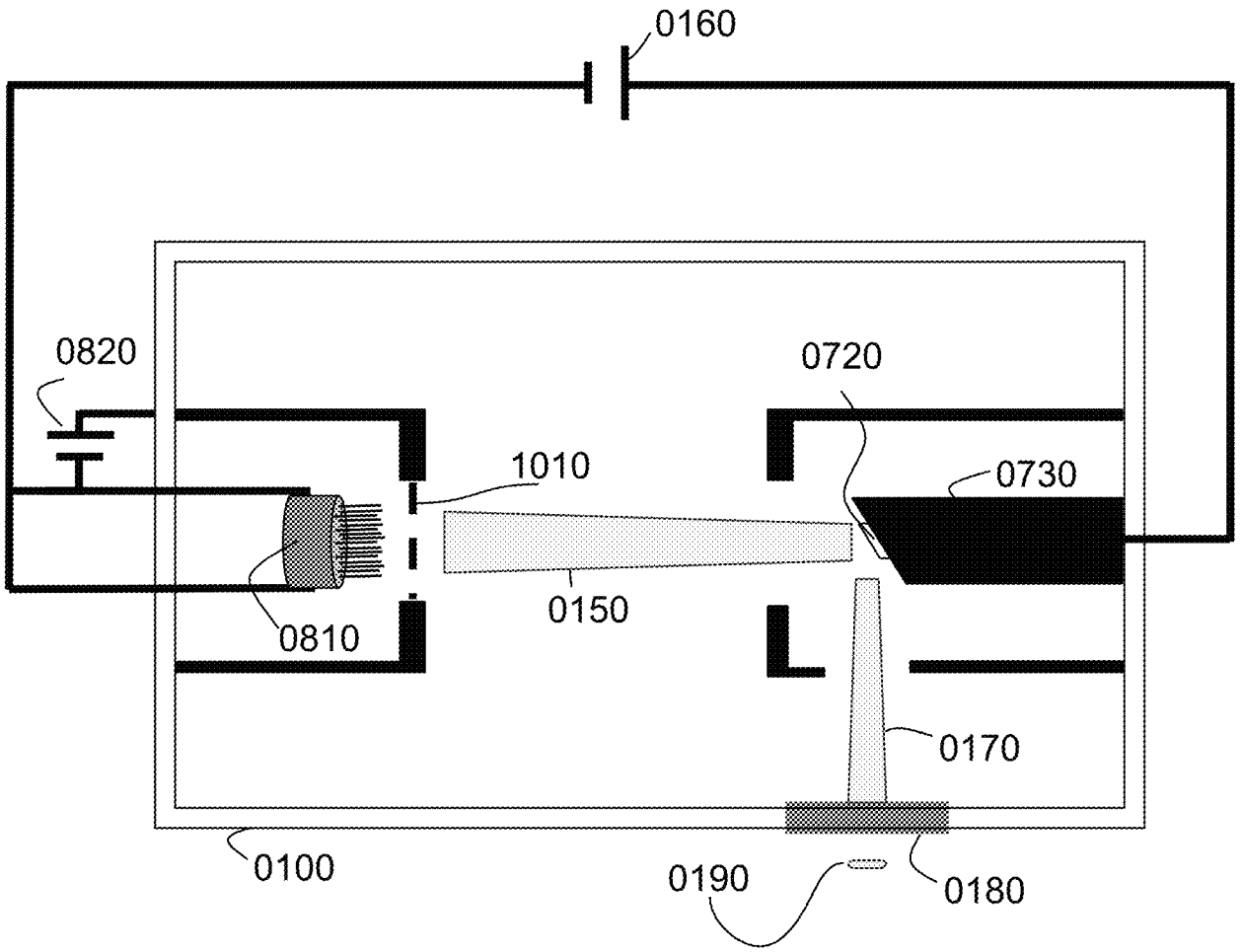
FIG. 10 is a schematic of an X-ray tube comprising a field emission cathode, a gate electrode and an electron antenna.

FIG. 10 is a schematic of such an X-ray tube comprising a field emission cathode 0810 and its power unit 0820, a gate electrode 1010, and one electron antenna comprising an antenna element 0720 and antenna base 0730.

The field emission cathode can be further configured to allow for thermally assisted emission, such as Schottky emission.

An X-ray device comprising the said electron antenna can be configured to one type of rotating anode micro- or nano-focus tube, when single or multiple antenna elements are circularly sandwiched in the rotating disc.

Figure 11A:
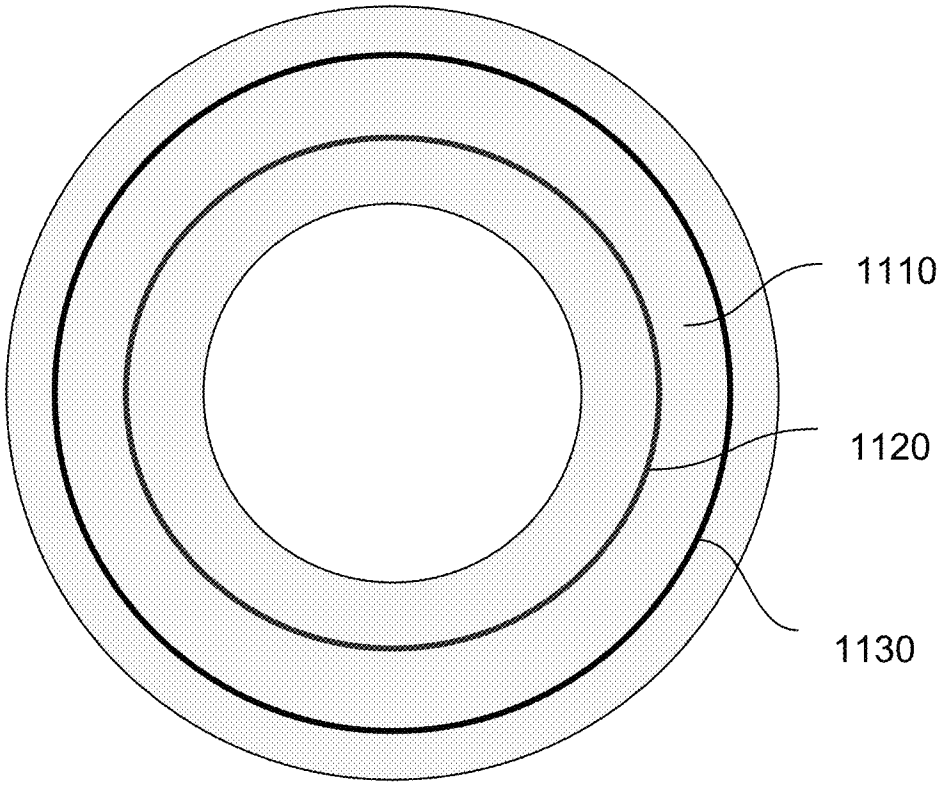
FIG. 11A and FIG. 11B are graphs illustrating two types of rotating anode tube solution using the electron antenna, according to some of the example embodiments described herein.

FIG. 11A illustrates this type of rotating anode solution, according to some of the example embodiments described herein; where 1110 denotes the rotating disc acting as the antenna base, 1120 and 1130 are two circular antenna elements sandwiched in the antenna base. The antenna base 1110 is seen from the above. There can be more than two antenna filaments in other embodiments. And the material of the antenna elements can be made different.

An X-ray device comprising the said electron antenna can be configured to another type of rotating anode micro- or nano-focus tube, when multiple antenna elements are radially sandwiched in the rotating disc with equal angular-space.

Figure 11B:
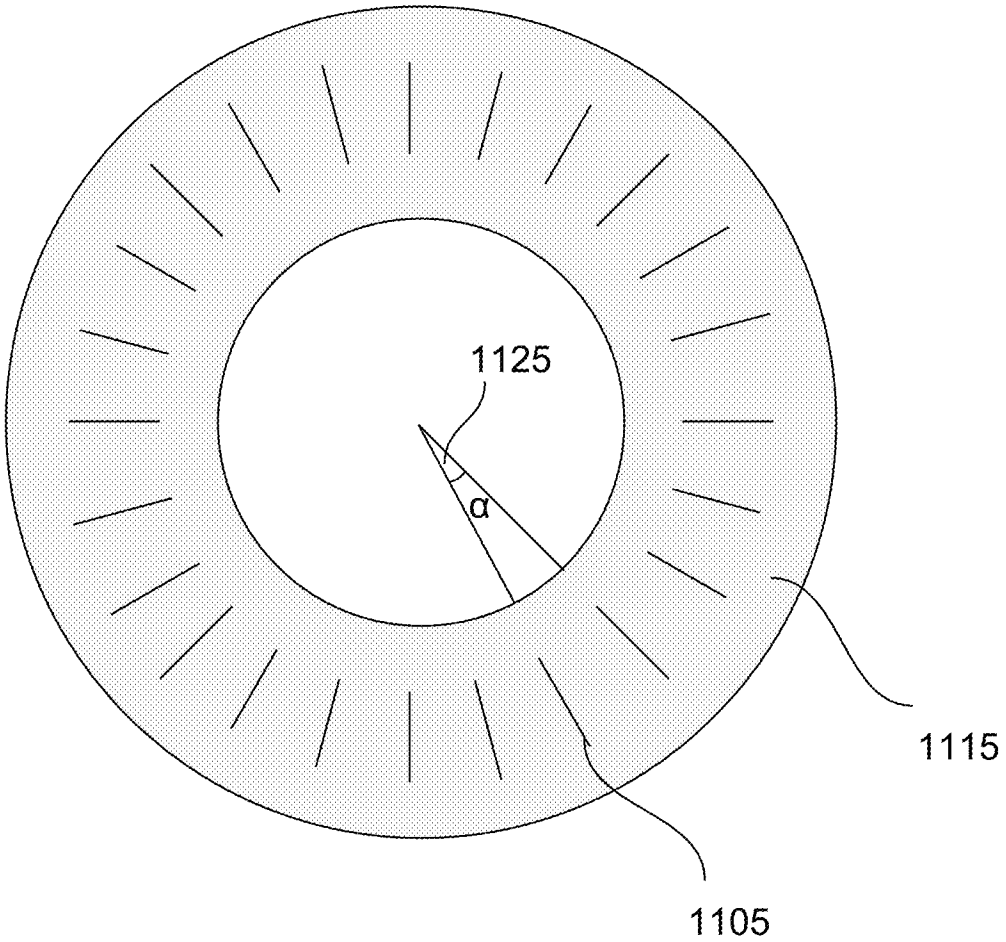

FIG. 11B illustrates this type of rotating anode solution, according to some of the example embodiments described herein; where 1105 denotes one of the antenna elements, 1115 denotes the rotating disc acting as the antenna base, and 1125 indicates the angular space between the antenna elements with $\alpha$ denoting its value. The number of antenna elements is determined by the pulse frequency of the electron emission and the speed of rotation. The antenna base 1115 is seen from above.

Example Advantages of Embodiments:

The concept of electron antenna and its use in X-ray tube redesign allow for a simpler and more economic approach to more compact micro or nano focus X-ray tubes than the liquid jet anode approach and the conventional approach of using electromagnetic lenses between the cathode and the anode. In the latter, even though the focal spot size can be focused to nanometre range, the drift of the focal spot can be significant, which is caused by among other factors the instability of the voltages applied to the lenses and the cathode and anode (Newsletter 01/2015, X-RAY WorX GmbH). The use of the said electron antenna is able to provide a drift-free focal spot whose size is in a range of millimetre down to nanometre scale. The drift-free focal spot is guaranteed by facts that the focal spot size is determined by the electron antenna element that is fixed mechanically to the solid antenna base and thus free from any motion. In addition, the shape of the antenna element and its large contact area to the antenna base provide a superior heat management solution. The use of the said electron antenna also allows the resulting micro focus tubes to be used in applications where macro focus tubes dominated prior.

Applications:

It should be appreciated that the X-ray device described herein may be used in a number of fields. For example, the X-ray device may be used in a security scanning apparatus, as one would find in an airport security check and post terminal.

A further example use of the X-ray device discussed herein is in medical scanning devices such as a computed tomography (CT) scanning apparatus or a C-arm type scanning apparatus, which may include a mini C-arm apparatus. A few example application of the X-ray device may be mammography, veterinary imaging and dental imaging.

A further example use of the X-ray device described herein is in a geological surveying apparatus, X-ray diffraction apparatus and X-ray fluorescence spectrometry, etc.

It should be appreciated that the X-ray device described herein may be used in any non-destructive testing apparatus.

It should be appreciated that the X-ray device described herein may be used in phase contrast imaging and colour CT scanner.

As previously mentioned the electron antenna works also for production of radiation with wavelengths other than X-rays. By replacing the metallic electron antenna element in the above description for production of an X-ray beam with an antenna element comprising UV light emitting material, such as quantum wells or quantum dots, production of UV light is possible. An improved focus of a UV light beam has similar advantages as for an X-ray beam. The drift-free focal spot is guaranteed by facts that the focal spot size is determined by the electron antenna element that is fixed mechanically to the solid antenna base and thus free from any motion. In addition, the shape of the antenna element and its large contact area to the antenna base provide a superior heat management solution. The use of the said electron antenna also allows the resulting micro focus tubes to be used in applications where macro focus tubes dominated prior.

Similarly, by replacing the metallic electron antenna element in the above description for production of an X-ray beam with an antenna element comprising visible light emitting material, such as a phosphorescent or fluorescent material, production of visible light is possible. An improved focus of a visible light beam has similar advantages as for an X-ray beam. The drift-free focal spot is guaranteed by facts that the focal spot size is determined by the electron antenna element that is fixed mechanically to the solid antenna base and thus free from any motion. In addition, the shape of the antenna element and its large contact area to the antenna base provide a superior heat management solution. The use of the said electron antenna also allows the resulting micro focus tubes to be used in applications where macro focus tubes dominated prior.

The description of the example embodiments provided herein have been presented for purposes of illustration. The description is not intended to be exhaustive or to limit example embodiments to the precise form disclosed, and modifications and variations are possible in light of the above teachings or may be acquired from practice of various alternatives to the provided embodiments. The examples discussed herein were chosen and described in order to explain the principles and the nature of various example embodiments and its practical application to enable one skilled in the art to utilize the example embodiments in various manners and with various modifications as are suited to the particular use contemplated. The features of the embodiments described herein may be combined in all possible combinations of methods, apparatus, modules, systems, and computer program products. It should be appreciated that the example embodiments presented herein may be practiced in any combination with each other.

It should be noted that the word "comprising" does not necessarily exclude the presence of other elements or steps than those listed and the words "a" or "an" preceding an element do not exclude the presence of a plurality of such elements. It should further be noted that any reference signs do not limit the scope of the claims, that the example embodiments may be implemented at least in part by means of both hardware and software, and that several "means", "units" or "devices" may be represented by the same item of hardware.

In the drawings and specification, there have been disclosed exemplary embodiments. However, many variations and modifications can be made to these embodiments. Accordingly, although specific terms are employed, they are used in a generic and descriptive sense only and not for purposes of limitation, the scope of the embodiments being defined by the following claims.

What is claimed is:

1. Anode for an X-ray tube, characterized in that the anode comprises an electron antenna comprising an antenna element X-ray emitter; wherein the antenna element is arranged on an antenna base; the electron antenna is configured in the same spatial relation to a cathode cup as in a stationary anode X-ray tube or rotating anode X-ray tube, wherein an upper part of the antenna element protrudes out of and parallel to a front surface of the antenna base, wherein the protrusion of the antenna element and an aspect ratio of the antenna element cause a local enhancement of an electric field at a top end of the antenna element, wherein a height h of protrusion of the antenna element is between 1 μm-5 mm from the antenna base and a top surface of the antenna element has an anode angle θ of 5°-45°.

2. The anode of claim 1, wherein the electron antenna comprises an antenna element in the shape of a blade, wherein the shape of the top surface of the blade is a cross, a square, a rectangle, linear segments, an elliptical disc or a circular disc.

3. The anode of claim 2, wherein a width t of the blade or of longitudinal sections of the cross, a long side of the rectangle, a side of the square or linear segments shape is between 10 nm-200 μm.

4. The anode of claim 2, wherein the circular disc comprises a radius R≤200 μm or where the elliptical disc has a semi-major axis r≤200 μm.

5. The anode of claim 1, wherein the electron antenna works as replacement of an anode in vacuum tubes for generating single or multiple micro- or nano-focus X-ray beam; wherein the antenna element is metallic and comprises one or more of the metals: W, Rh, Mo, Cu, Co, Fe, Cr and Sc; or one or more of the alloys: W—Re, W—Mo, Mo—Fe, Cr—Co, Fe—Ag and Co—Cu—Fe.

6. The anode of claim 1, wherein the antenna base comprises electrically conductive the material which is one or more of: Cu and Mo.

7. The anode of claim 1, wherein the antenna base comprises an electrically insulating material and wherein a plurality of antenna elements are arranged on the antenna base.

8. The anode of claim 7, wherein the electrically insulating material is one or more of: BN, $Al_2O_3$.

9. An X-ray generating device comprising the anode of claim 1.

10. The X-ray generating device of claim 9, wherein said X-ray generating device is a single hot cathode micro- or nano-focus tube by using a hot filament cathode.

11. The X-ray generating device of claim 10 comprising the said anode can be configured to a single field emission cathode micro- or nano-focus tube by using a field emission cathode.

12. The X-ray generating device of claim 11, wherein the field emission cathode can be further configured to allow for thermally assisted emission, such as Schottky emission.

13. The X-ray generating device of claim 10, wherein the X-ray generating device is a rotating anode micro- or nano-focus tube, wherein a plurality of antenna elements are radially embedded in a rotating antenna base disc.

14. The X-ray generating device of claim 9, wherein said X-ray generating device is a dual cathode micro- or nano-focus tube by using a cathode assembly holding a field emission cathode and a hot filament cathode.

15. The X-ray generating device of claim 14, wherein said X-ray generating device further comprises an electron emitter comprising a gate electrode, thereby making the X-ray generating device a triode field emission micro- or nano-focus tube.

16. The X-ray generating device of claim 9, wherein said X-ray generating device is a micro- or nano-focus tube with multiple excitation sources comprising multiple cathodes and anodes.

17. The X-ray generating device of claim 9, wherein the X-ray generating device is a rotating anode micro- or nano-focus tube, wherein one or a plurality of antenna elements are concentrically embedded in a rotating antenna base disc.

18. An apparatus comprising an X-ray generating device according to claim 1, wherein said apparatus is a computed tomography (CT) scanning apparatus, a C-arm type scanning apparatus, a mini C-arm type scanning apparatus, a geological surveying apparatus, an X-ray diffraction apparatus, X-ray fluorescence spectroscopy, an X-ray non-destructive testing apparatus, phase contrast imaging or in a colour CT scanner.

19. An anode for an X-ray tube, characterized in that the anode comprises an electron antenna comprising an antenna element X-ray emitter; wherein the antenna element is arranged on an antenna base; the electron antenna is configured in the same spatial relation to a cathode cup as in a stationary anode X-ray tube or rotating anode X-ray tube, wherein an upper part of the antenna element protrudes out of and parallel to a front surface of the antenna base, wherein the protrusion of the antenna element and an aspect ratio of the antenna element cause a local enhancement of an electric field at a top end of the antenna element, wherein the aspect ratio of a blade, defined as the division of a height h to a width t, is in the range of 10-100.

20. An anode for an X-ray tube, characterized in that the anode comprises an electron antenna comprising an antenna element X-ray emitter; wherein the antenna element is arranged on an antenna base; the electron antenna is configured in the same spatial relation to a cathode cup as in a stationary anode X-ray tube or rotating anode X-ray tube, wherein an upper part of the antenna element protrudes out of and parallel to a front surface of the antenna base, wherein the protrusion of the antenna element and an aspect ratio of the antenna element cause a local enhancement of an electric field at a top end of the antenna element, wherein a metallic antenna element is a tungsten blade and the antenna base comprises two half cylindrical copper parts, wherein the tungsten blade is sandwiched in between the two half cylindrical copper pieces in such a way that a first blade edge of the tungsten blade is protruding from a front surface of the copper cylinder.

* * * * *